US006733333B1

(12) United States Patent
Chen

(10) Patent No.: US 6,733,333 B1
(45) Date of Patent: May 11, 2004

(54) TRANSMISSION CABLE HAVING OPERATION STATUS INDICATOR MEANS

(76) Inventor: Wilson Chen, 4F, No. 3, Alley 9, Lane 45, Pao-Hsin Rd., Hsin-Tien, Taipei (TW)

( * ) Notice: Subject to any disclaimer, the term of this patent is extended or adjusted under 35 U.S.C. 154(b) by 0 days.

(21) Appl. No.: 10/378,640

(22) Filed: Mar. 5, 2003

(51) Int. Cl.[7] ..... H01R 11/00
(52) U.S. Cl. ..... 439/552; 439/660
(58) Field of Search ..... 439/552, 551, 439/623, 624, 660

(56) References Cited

U.S. PATENT DOCUMENTS 6,283,789 B1 * 9/2001 Tsai ..... 439/502
2002/0142665 A1 * 10/2002 Nishio et al. ..... 439/660
2003/0207611 A1 * 11/2003 Lin et al. ..... 439/501
2003/0228791 A1 * 12/2003 Milan ..... 439/502

* cited by examiner

*Primary Examiner*—Jean F. Duverne
(74) *Attorney, Agent, or Firm*—Rosenberg, Klein & Lee

(57) ABSTRACT

A transmission cable having a cable and two connectors at the ends of the cable is disclosed to include an integrated circuit and a LED in the transparent plastic housing of each connector. The integrated circuit drives the LED to emit light after installation of the transmission cable, and drives the LED to flash upon transmission of signal/data through the cable. The LED is off when the transmission cable failed.

1 Claim, 5 Drawing Sheets

TRANSMISSION CABLE HAVING OPERATION STATUS INDICATOR MEANS

BACKGROUND OF THE INVENTION

1. Field of the Invention

The present invention relates to an electric cable and, more particularly, to a transmission cable that has means to indicate the operation status.

2. Description of the Related Art

FIG. 1 shows a transmission cable 10 according to the prior art. According to this design, the transmission cable 10 has two connectors 11 respectively disposed at the ends. Each connector 11 has an insulating housing 12 for the holding of the hand to connect the respective connector 11 to the matching connector or to disconnect the respective connector 11 from the matching connector. This design of transmission cable 10 can be used in a computer system, digital stereo system, or communication system. The transmission cable 10 shown in FIG. 1 is a USB (Universal Serial Bus) connector. A LPT port transmission cable or COM port transmission cable can be made in a similar structure with the exception of the nature of the connectors.

When the aforesaid transmission cable 10 connected between for example, a peripheral apparatus and a computer for transmitting data or signal, the user cannot know the transmission status of the transmission cable 10 visually. If the transmission cable 10 fails due to broken conductors, the user cannot immediately determine the reason of the disconnection between the peripheral apparatus and the computer. The user may waste a lot of time in checking the computer or the peripheral apparatus before finding out the trouble of the transmission cable 10.

SUMMARY OF THE INVENTION

The present invention has been accomplished under the circumstances in view. It is therefore the main object of the present invention to provide a transmission cable, which emits light when installed, and gives no light when failed after installation. It is another object of the present invention to provide a transmission cable, which drives a LED to flash upon transmission of signal/data through the cable. To achieve these and other objects of the present invention, the transmission cable comprises a cable and two connectors at the ends of the cable. Each connector comprises a transparent plastic housing, and an integrated circuit and a LED embedded in the transparent plastic housing and electrically connected to the circuit of the respective connector. The integrated circuit drives the LED to emit light after installation of the transmission cable, and drives the LED to flash upon transmission of signal/data through the cable. The LED is off when the transmission cable failed.

DETAILED DESCRIPTION OF THE PREFERRED EMBODIMENT

Figure 1:
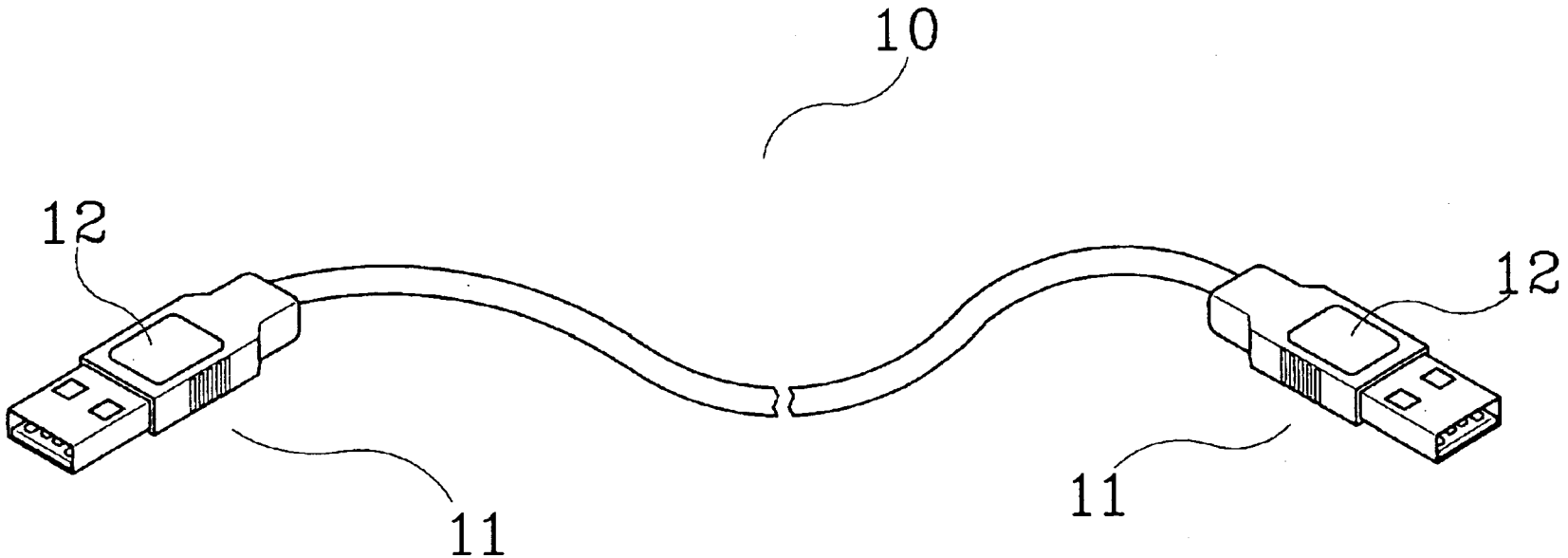
FIG.1(PRIOR ART)
FIG. 1 is an elevational view of a transmission cable according to the prior art.
Figure 2:
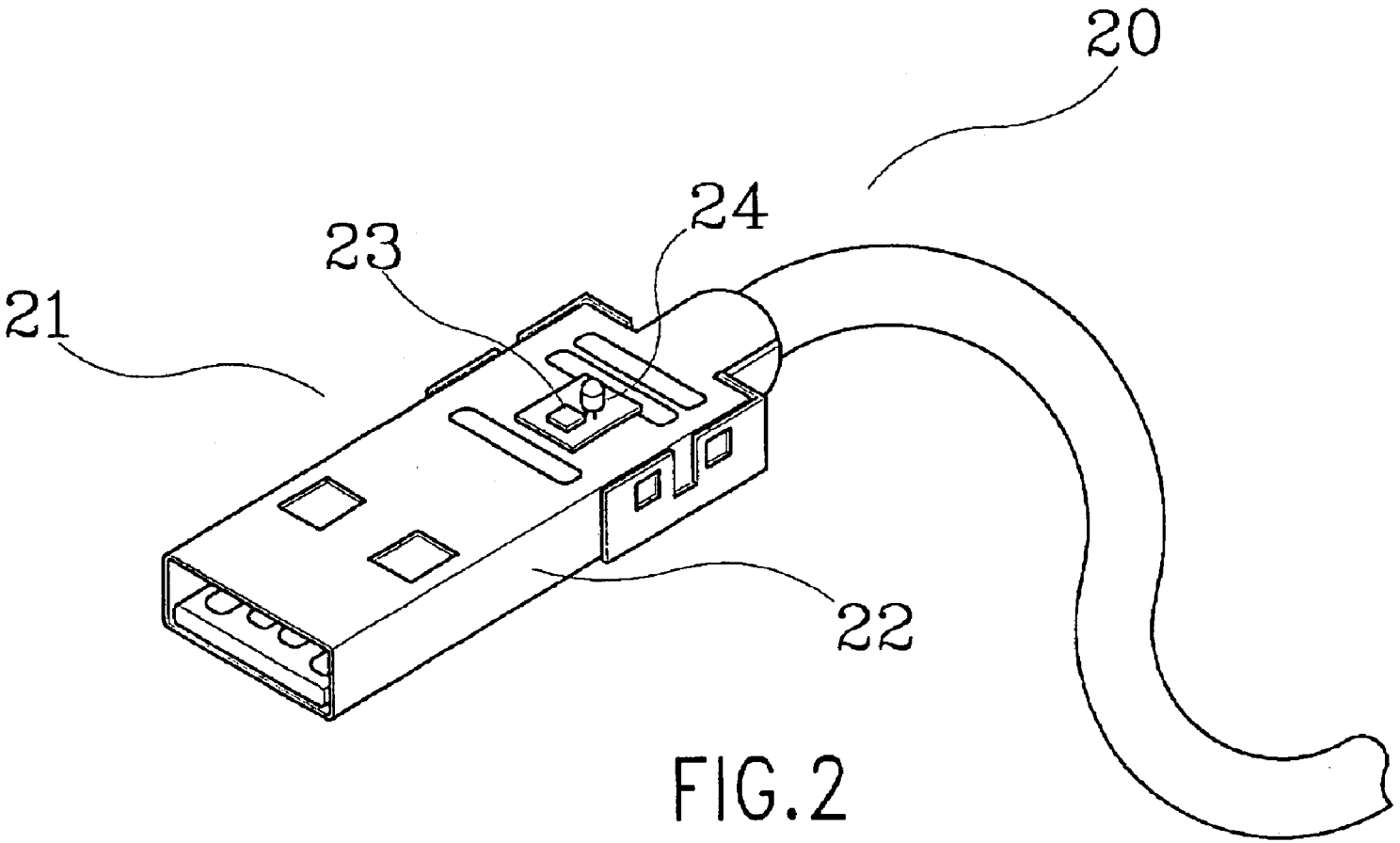
FIG. 2 is a perspective view of a part of a transmission cable according to the present invention before the molding of a transparent plastic housing on the connector body.
Figure 3:
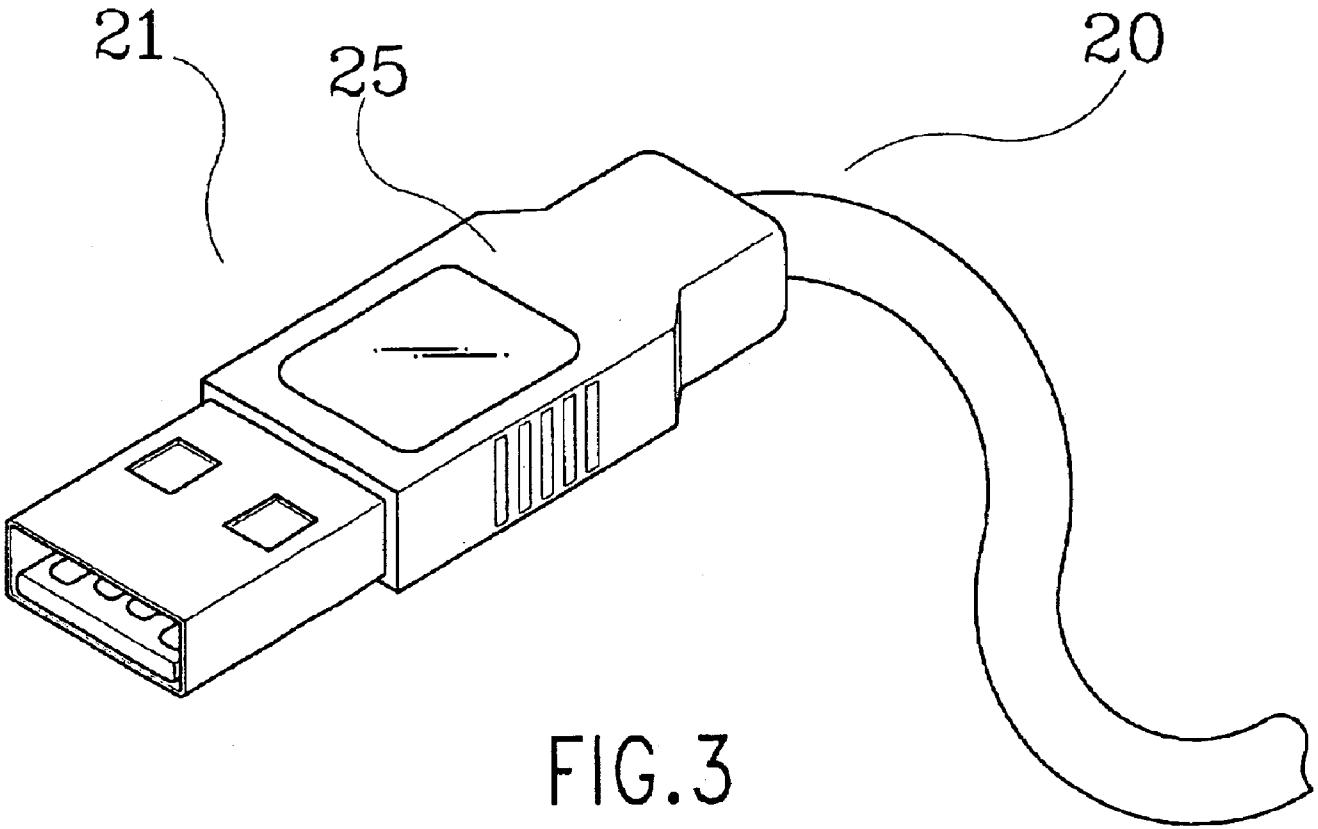
FIG. 3 is similar to FIG. 2 but showing the connector body of the connector covered with a transparent plastic housing.

Referring to FIGS. 2 and 3, a transmission cable 20 in accordance with the present invention can be made in the form of a USB transmission cable, a LPT port transmission cable, or a COM port transmission cable for use in a computer system, digital stereo system, or communication system. The transmission cable 20 comprises two connectors 21 respectively located on the ends of the cable thereof. Each connector 21 comprises a connector body 22, an integrated circuit 23 and a LED (light emitting diode) 24 installed in the connector body 22, and a transparent plastic housing 25 covering a part of the periphery body 22 over the integrated circuit 23 and the LED 24.

The integrated circuit 23 and the LED 24 obtain power source from the power circuit of the computer. The integrated circuit 23 scans the conductors of the cable of the transmission cable 20. When the transmission cable 20 does no work after having been connected between the peripheral apparatus and the computer, the integrated circuit 23 drives the LED 24 to emit light, indicating normal status of the transmission cable 20. On the contrary, when the transmission cable 20 failed, the LED 24 is off. During signal or data transmission between the computer and the peripheral apparatus through the transmission cable 20, the integrated circuit 23 drives the LED 24 to flash.

As indicated above, the LED 24 is constantly maintained in "on" status after installation of the transmission cable 20 when the transmission cable 20 does no work, or driven to flash when the transmission cable 20 transmitting data or signal between the peripheral apparatus and the computer. In case the LED 24 fails to emit light after installation of the transmission cable 20, it means that the transmission cable 20 failed.

Figure 4:
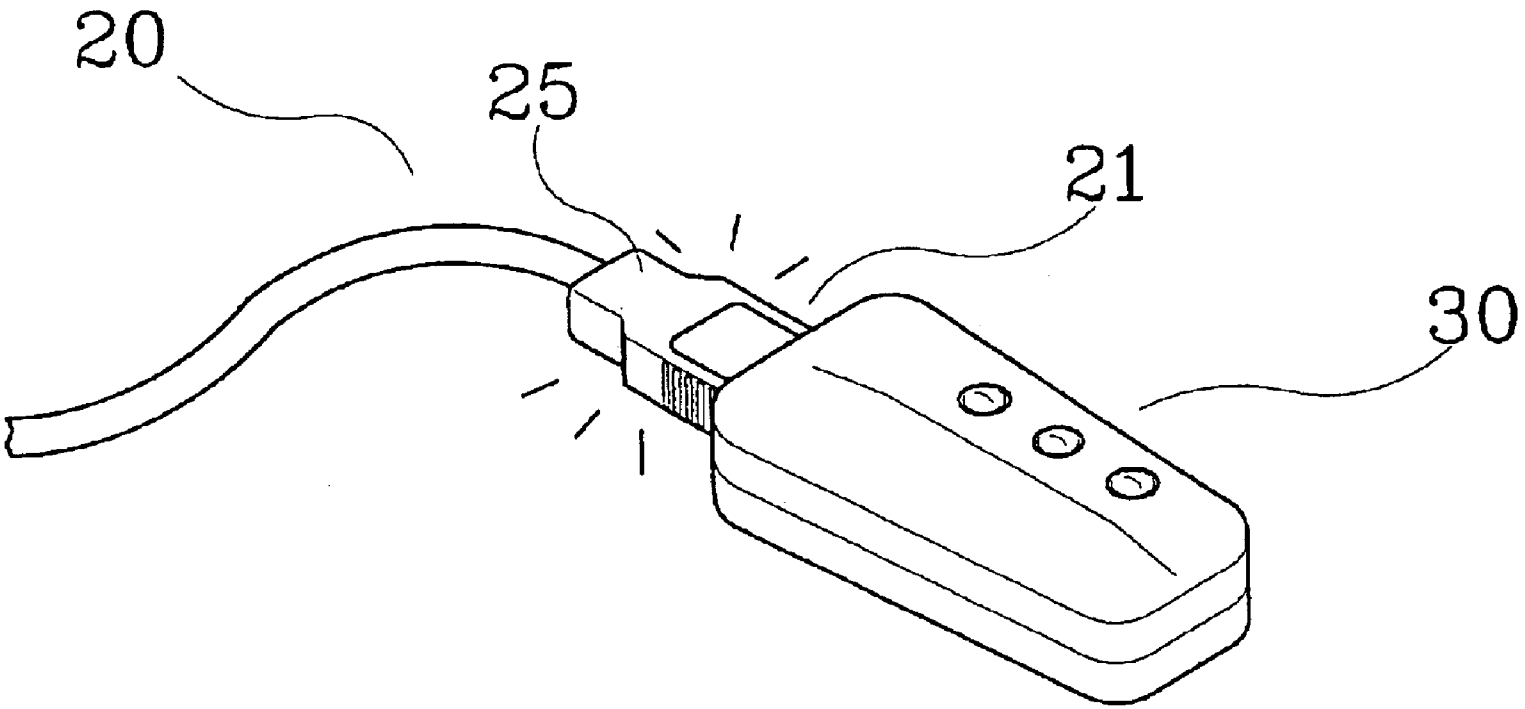
FIG. 4 is a schematic drawing showing one application example of the present invention.

FIG. 4 shows one application example of the present invention. As illustrated, one connector 21 of the transmission cable 20 is connected to a MP3 player 30, and the corresponding LED (not shown) emits light through the transparent plastic housing 25 of the corresponding connector 21. Subject to the emitting status of the LED, the user knows the functioning of the transmission cable 20.

Figure 5:
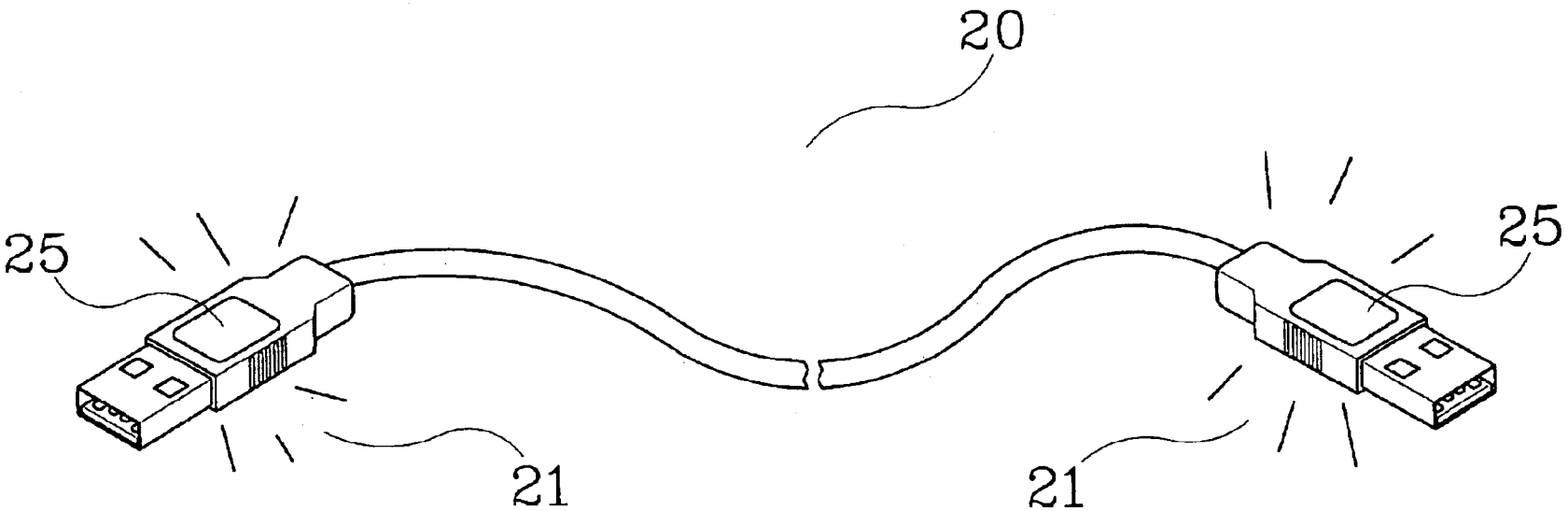
FIG. 5 is a schematic drawing showing another application example of the present invention.

FIG. 5 shows another application example of the present invention. According to this embodiment, both connectors 21 are respectively provided with a respective integrated circuit and a respective LED. When the transmission cable 20 connected between a peripheral apparatus and a computer, the LEDs of the connectors 21 emit light through the respective transparent plastic housings 25, indicating normal functioning of the transmission cable.

A prototype of transmission cable having operation status indicator means has been constructed with the features of FIGS. 2~5. The transmission cable having operation status indicator means functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A transmission cable for connection between two electronic apparatus for transmitting data and signal, the transmission cable comprising a cable, two connectors located on two ends of said cable, said connectors each having a transparent plastic housing, and at least one operation status indicator means installed in said two connectors, said at least one operation status indicator means each comprising a light emitting means and an integrated circuit installed in one of said two connectors, said integrated circuit scanning the connection status of conductors of the transmission cable and driving said light emitting means to emit light through the transparent plastic housing of the corresponding connector when the transmission cable connected between two electronic apparatus, said integrated circuit driving said light emitting means to flash upon transmission of signal/data through the transmission cable.

* * * * *